United States Patent [19]

Flint et al.

[11] 4,083,100

[45] Apr. 11, 1978

[54] METHOD OF MANUFACTURING A KEYBOARD ASSEMBLY

[75] Inventors: John E. Flint, Herkimer; Stephen E. Dudek, Clayville, both of N.Y.

[73] Assignee: Mohawk Data Sciences Corporation, Herkimer, N.Y.

[21] Appl. No.: 761,925

[22] Filed: Jan. 24, 1977

[51] Int. Cl.[2] ..... H01H 11/00

[52] U.S. Cl. ..... 29/622; 29/407; 29/626; 29/464; 156/290; 200/5 A; 200/159 B

[58] Field of Search ..... 29/407, 622, 626, 464, 29/468; 340/365 R; 156/64, 182, 212, 230, 234, 290, 292, 580, 583; 200/5 A, 159 B, 275

[56] References Cited

U.S. PATENT DOCUMENTS

| | | | |
|---|---|---|---|
| 3,749,859 | 7/1973 | Webb et al. | 200/5 A X |
| 3,859,723 | 1/1975 | Hamer et al. | 29/626 |
| 3,886,012 | 5/1975 | Slater | 156/290 X |
| 4,033,030 | 7/1977 | Robinson | 29/622 |
| 4,042,439 | 8/1977 | Pounds | 156/292 |

*Primary Examiner*—Victor A. DiPalma
*Attorney, Agent, or Firm*—Robert R. Hubbard

[57] ABSTRACT

An improved method is disclosed for manufacturing a keyswitch assembly which includes a plurality of switches in a predefined arrangement on the face of an insulative circuit board and which also has a protective, insulative coating over the switches and board face. Each of the switches includes a pair of spaced contacts on the board face and a resilient, deformable, electrically conductive actuating element which can be selectively deformed to provide an electrical circuit between the two contacts. The method is performed with the aid of a planar template having a plurality of apertures positioned in a predefined arrangement corresponding to the arrangement of the switches on the circuit board. As an initial step, an insulative sheet, eventually forming the coating, is placed on a flat surface and the template is placed on top of the sheet so that the sheet is sandwiched between the template and the surface. Next, a plurality of actuating elements are secured to the sheet by being inserted, in an inverted position, into different template apertures and bonded to the sheet at the point of contact therewith. This forms an assembly sheet comprising the original insulative sheet with the actuating members secured thereto, which assembly sheet is conveniently handled as a unit for accurate alignment and bonding to the circuit board. High accuracy is achieved in aligning the assembly sheet with respect to the circuit board by using alignment guides which are constructed to mount in registry over the contacts of switches in the four corners of the circuit board so as to permit aligning of the actuating elements in the four corners of the assembly sheet with their corresponding switch contacts. After such alignment, the assembly sheet is spot-bonded to the circuit board in each of its corners and, thus restrained, is quickly and accurately bonded to the circuit board on a conventional press.

21 Claims, 7 Drawing Figures

METHOD OF MANUFACTURING A KEYBOARD ASSEMBLY

This invention relates generally to switch assemblies for sensing the activation of keys in a keyboard system and, more particularly, concerns a method for manufacturing such a keyswitch assembly which includes a plurality of switches in a predefined arrangement on the face of an insulative circuit board and which also has a protective, insulative coating over the switches and board face.

Keyswitch assemblies for sensing the activation of keys in a keyboard system and for producing signals representative of these key activations are well-known in the prior art. A particularly efficient keyswitch assembly is disclosed in U.S. pat. application Ser. No. 505,389, filed by M. S. Robinson et al. on Sept. 12, 1974, now U.S. Pat. No. 4,018,999. In accordance with Robinson et al, a keyswitch assembly having a plurality of switches in a predefined arrangement is formed on one face of an insulative circuit board and a protective insulative coating is provided over the entire circuit board to retain the switches on the board, as well as to seal them. Each switch has an annular outer contact and a concentric inner contact, and includes a resiliently deformable, dome-shaped actuating element. The actuating element has an annular marginal edge which is shaped to coincide with the outer contact and is positioned on top of the outer contact to protrude thereabove. In operation, a downward force is applied to the upwardly protruding portion of the actuating element so that the element is deformed downwardly and touches the inner contact, thereby completing an electric circuit between the inner and outer contacts.

As taught in U.S. Pat. No. 3,653,038, issued to J. R. Webb et al. on Mar. 28, 1972, keyswitches of the type described may also be formed with a thin film of dielectric over the inner contact. With keyswitches of this type,, when the actuating member is deformed as explained above, no direct conductive path is formed between the inner and outer contacts. Rather, deforming the actuating member greatly increases the capacitance between the contacts, so that a current surge, which is detectable by known means, is produced in a coupled associated circuit.

In manufacturing keyswitch assemblies of the type described above, the accurate positioning of the actuating members with respect to the outer contacts has proved to be an ever-present, difficult and time-consuming problem. Moreover, existing solutions to this problem have proven too inaccurate or have required unnecessarily complex and expensive equipment. For example, Robinsion et al suggested that the actuating members be initially oriented with respect to the circuit board by means of an appropriate template. Before the protective sheet could be secured over the circuit board, however, the template had to be removed. As a result, the actuating members had to be retained in place independently of the template, once they were positioned with respect to the circuit board. This required that the actuating members be assembled to the circuit board on a specially designed transfer base, which was constructed to receive the circuit board and to retain the domes with respect thereto by means of an externally applied vacuum or by means of magnet members. The transfer base not only constituted an additional complication and expense in the assembly process, but also led to difficulties in accurate alignment, because the transfer base, the circuit board and the template all had to be aligned accurately. Furthermore, when the template was removed, the actuating members were in an exposed position above the circuit board and although restrained with respect to the circuit board, could be damaged or accidentally moved out of position during assembly. Also, the insulative sheet was placed on top of the circuit board and actuating members prior to being secured thereto and, in being moved about, could accidentally displace one or more actuating members. In addition, the sheet was supported only on the tops of the actuating members and was not held flat immediately prior to being secured to the board. Thus, creases or similar imperfections in the sheet material near the perimeter of an actuating member might not be secured to the board and would permit some movement of the actuating member. This could result in the actuating member moving with respect to the circuit board during operation, so that, even with accurate initial positioning, the actuating member might move out of postion during use. The foregoing and other limitations on positioning accuracy, convenience and reliability were significant disadvantages inherent in prior art methods of constructing keyswitch assemblies of the type described.

Broadly, it is an object of this invention to provide a method of manufacturing keyswitch assemblies which overcomes the disadvantages of prior art manufacturing methods. Specifically, it is within the contemplation of the present invention to provide an improved method for manufacturing keyswitch assemblies which include switches of both the contact and capacitive type.

It is another object of this invention to provide a method for manufacturing keyswitch assemblies of the type described, which method is more reliable than existing manufacturing methods and provide accurate alignment between the contacts and actuating member of each of the switches in a keyswitch assembly.

It is yet another object of this invention to provide a method for manufacturing keyswitch assemblies of the type described wherein the actuating members are retained against displacement during adhesion of the insulative sheet to the circuit board, which method does not required the use of a transfer base of other auxiliary means to retain the actuating members.

It is a further object of this invention to assemble keyswitch assemblies of the type described in a manner which will assure that the actuating members are retained in their predefined relative positions while being protected against accidental damage or injury.

It is yet another object of this invention to assemble keyswitch assemblies of the type described in such a manner that creases and similar imperfections in the sheet of insulative material will not affect the accuracy of aligment between the actuating member and contacts of the switches.

It is also an object of this invention to provide a method for manufacturing keyswitch assemblies of the type described, which method is accurate, convenient and reliable in use, yet can be performed without specialized, expensive equipment and by workers having a minimum level of skill.

In accordance with an illustrative embodiment demonstrating objects and features of the present invention, there is provided an improved method for manufacturing keyswitch assemblies of the type described. The method is performed with the aid of a planar template having a plurality of apertures positioned in a predefined arrangement corresponding to the arrangement of the outer switch contacts on the circuit board. As an initial step, the insulative sheet is placed on a flat surface and the template is placed on top of the sheet so that the sheet is sandwiched between the template and the surface. Next, a plurality of actuating members are secured to the sheet by being inserted, in an inverted position, into the template apertures and bonded to the sheet at the point of contact therewith. This forms an assembly sheet comprising the original insulative sheet with the actuating members secured thereto, which assembly sheet is conveniently handled as a unit for accurate alignment and bonding to the circuit board. High accuracy is achieved in aligning the assembly sheet with respect to the circuit board by using alignment guides which are constructed to mount in registry over the contacts of switches in the four corners of the circuit board. Each alignment guide includes a circular aperture dimensioned to be slightly larger thn the periphery of an actuating member. When the alignment guide is mounted in position on the board, a circle may be scribed on the outer contacts of the switches in the four corners of the board. Prior to adhering the assembly sheet to the circuit board, the actuating members in the four corners of the assembly sheet are accurately aligned within the scribed circles on the four corner contacts of the circuit board and the assembly sheet is spot-bonded to the circuit board in each of its corners. With the assembly sheet thus restrained, it is quickly and accurately bonded to the circuit board.

It is a feature of this invention that the actuating members are bonded to the insulative sheet through the apertures of a template, constructed as described, while the insulative sheet is sandwiched between the template and the flat surface, so that creases and similar imperfections in the surface of the insulative sheet are smoothed out and do not affect the accuracy of the relative positioning of the actuating members.

It is another feature of this invention that, as an intermediate step, there is produced an assembly sheet comprising said insulative sheet with said actuating member secured thereto in a precise, predefined arrangement, which assembly sheet is conveniently handled as a unit for alignment with and bonding to said circiut board.

It is yet another feature of this invention that alignment guides, constructed to mount on the circuit board in registry with certain predefined contact members, are utilized to aid in orienting the assembly sheet with respect to the circuit board.

The foregoing brief description, as well as further objects, features and advantages of the present invention will be more completely understood from the following detailed description of a presently preferred, but nonetheless illustrative, embodiment of the present invention, with reference being had to the accompanying drawing, wherein.

Figure 1:
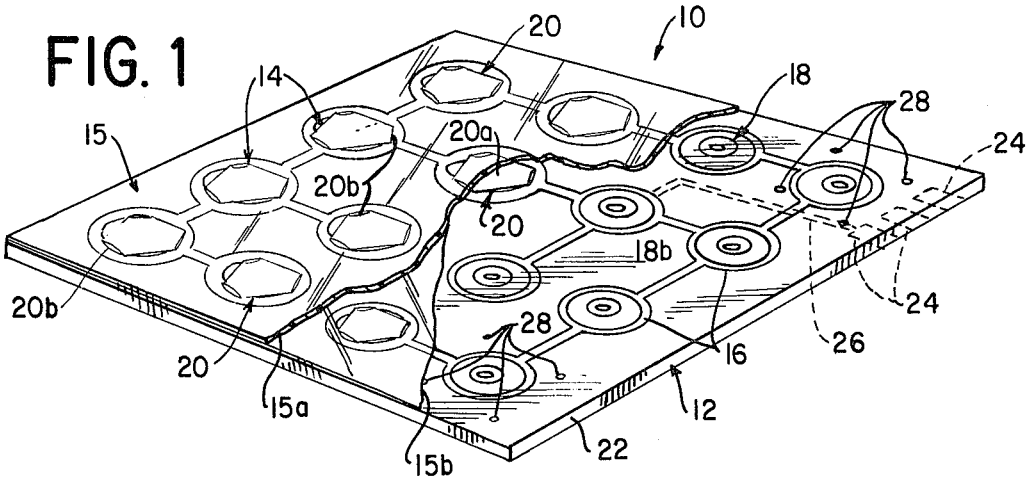
FIG. 1 is a perspective view illustrating a keyswitch assembly constructed in accordance with the present invention, with portions cut away to show construction details.
Figure 6:
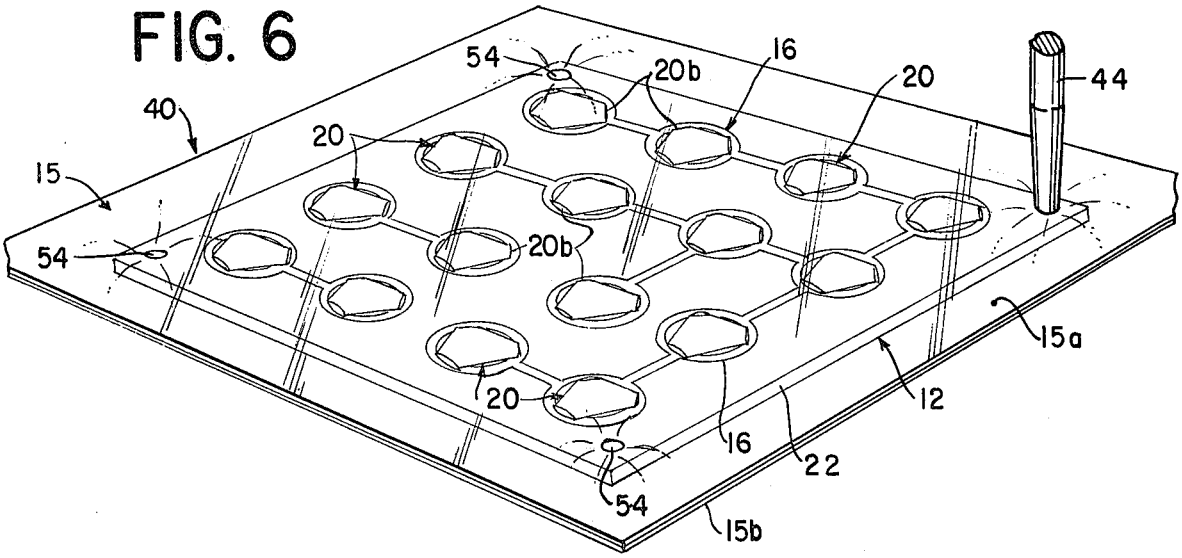
Figure 7:
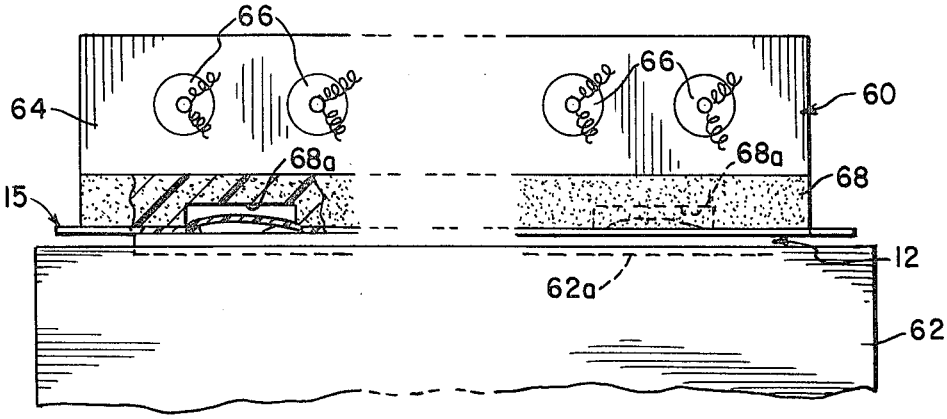

FIg. 6 illustrates a keyswitch assembly with the assembly sheet aligned with the contacts on the circuit board and being spot-bonded thereto at its four corners; and FIG. 7 is a side elevational view, with portions cut away, showing the circuit board and the spot-bonded assembly sheet mounted in a press and being pressure and heat bonded together. de Referring now to the details of the drawing, and in particular to FIG. 1, there is shown a keyswitch assembly, represented generally by the numeral 10, of one type which can be constructed with the method of the present invention. The keyswitch assembly 10 includes a circuit board 12, a plurality of switches 14 formed on the upper surface of the circuit board in a predefined pattern, and a protective coating 15 of insulative sheet material which is bonded to the surface of the circuit board and the switches so as to protect and seal the switches. It will be observed that each of switches 14 includes an annular outer contact 16, a concentric inner contact 18 and a generally triangular, conductive actuating member 20 overlying the contacts, all of which will be described in more detail hereinafter.

Circuit board 12 may be any form of conventional printed circuit board comprising a rigid board 22 formed of an insulative material, usually in laminate form, and a predefined arrangement of conductive material, such as copper, formed on a surface of the board 22. In the board illustrated, the conductive coating on the top surface is designed to form the outer contacts 16 and the inner contacts 18 of each of the switches 14, as well as the various interconnecting conductors between the outer contacts 16. Four precisely positioned holes 28, of a predetermined diameter, are bored about outer contact 16 of each of the switches 14 in the four corners of printed circuit board 12 for a purpose which will be explained in detail hereinafter.

Figure 2:
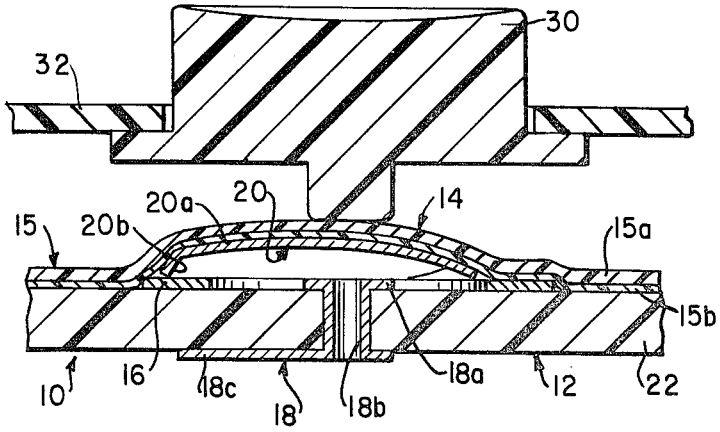
FIG. 2 is a fragmentary sectional view, on an enlarged scale, showing a single key and contact type switch in a keyboard employing a keyswitch assembly in accordance with the present invention.

As best shown in FIG. 2, each of inner contacts 18 includes an upper portion **18*a* secured to the upper surface of board 22, a plated-through hole 18*b* extending through board 22, and a lower portion 18*c* on the undersurface of board 22. As is well-known in the art, a plurality of conductive contact fingers 24 is provided on the undersurface of board 22 at one edge thereof to provide an electrical connection to circuits external of board 22. Access to the center contacts 18 is provided by means of a plurality of conductors 26 (only one is shown in FIG. 1), each of which is formed on the undersurface of board 22 and provides an electrical connection between one of center contacts 18 and a unique one of tongues 24. Although not shown in FIG. 1, a conductive connection between outer conductors 16 and a unique one of tongues 24** is similarly provided.

Although a particular type of circuit board and a specific arrangement of switches 14 have been shown for illustrative purposes, it is not intended that the method of the invention be limited to these specific structures, and it will be appreciated that the method of the invention is applicable to other conventional printed circuit boards and switch arrangements.

Actuating members 20 are made of a resilient, conductive material, preferably sheet metal, in the shape of a triangle with truncated corners. They are formed to be slightly bowed so that they have a generally convex upper surface 20*a*, and, in each of the corners of the triangle, include a depending leg 20*b*. It will be appreciated that bowing the actuating members 20 adds to their resilience. Each of the actuating members 20 is positioned over outer contact 16 of a corresponding switch 14 so that the legs 20*b* are in contact with outer contact 16. This permits downward deformation of the actuating member to establish an electrical connection between the inner and outer contacts 16 and 18, as will be more fully explained hereinafter.

The insulative coating 15 is bonded to the upper surface of printed circuit board 12, is spot-bonded to each of actuating members 20, and thereby functions not only to restrain actuating members 20 against movement with respect to contact 16, but also seals the individual switches 14 against the entry of dust and other foreign matter. In the preferred embodiments, the protective film 15 is transparent and comprises a thick upper film 15*a* of thermoplastic material, such as polypropylene, and a thinner lower film 15*b* made of a sealable thermoplastic material, such as polyvinylidiene chloride (alos known as saran). A saran film has been found to be particularly effective for this application because it bonds well to both the circuit board 12 and actuating members 20. A coated sheet of the type described is available for Hercules Corporation under the designation 75Ga type 501/1S coated film.

Referring now to FIG. 2, there is shown a portion of a keyboard incorporating a keyswitch assembly of the type shown in FIG. 1. In addition to the keyswitch assembly 10, the keyboard includes a key 30 and a key retaining member 32, both of which are conventionally employed in keyboards of the type used, for example, in electronic calculators. In operation, when the key 30 is depressed, the actuating member is deformed downwardly to engage portion 18*a* of contact 18. This establishes an electrical connection between contact 16 and contact 18 and results in the transmission of an electrical signal to external circuitry via corresponding ones of contact fingers or tongues 24, as is well known in the art. When key 30 is released, actuating member 20 returns to its undistorted shape as a result of its resilience, and the electrical connection between contacts 16 and 18 is opened.

Figure 3:
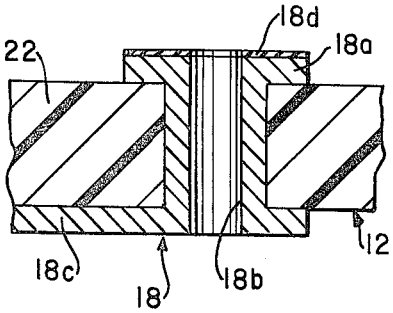
FIG. 3 is a sectional view, on an enlarged scale, showing the center contact of a capacitive-type switch and illustrating the modification necessary to form that type of switch.

The printed circuit board 12 and the keyboard illustrated in FIg. 2 may be modified, as shown in FIG. 3, by providing a thin dielectric coating 18*d* on top of each of contacts 18. When printed circuit board 12 is so modified, the switches 14 no longer function as contact switches, which establish a direct conductive path between the outer and inner contacts 16, 18 upon deformation of actuating element 20. Instead, they furnction as capacitive switches in which the deformation of actuating element 20 to place it in contact with dielectric coating 18*d* instroduces a large capacitance between outer and inner contacts 16, 18. The introduction of this large capacitance produces a current surge between contacts 16 and 18 in the circuit including the corresponding switch 14, which current surge is detectable by external circuitry which is well-known in the art.

It will be appreciated that, in both contact type and capacitive type switches, the deformation of actuating member 20 provides an electric circuit between the outer and inner contacts 16, 18. With the former type of switch, the circuit is a direct conductive path, and with the latter type of switch, it is a capacitance. The method of the present invention is intended to be used with printed circuit boards employing both types of switches.

The method of constructing a keyswitch assembly in accordance with the present invention includes three main steps: constructing an assembly sheet 40 to which the actuating members 20 are dependingly secured in a precise arrangement corresponding to the predefined arrangement of switches 14 on the surface of printed circuit board 12; precisely aligning the assembly sheet with the printed circuit board 12 so that each of the actuating members 20 overlies the corresponding outer contact 16; and bonding the assembly sheet 40 to printed circuit board 12.

Figure 4:
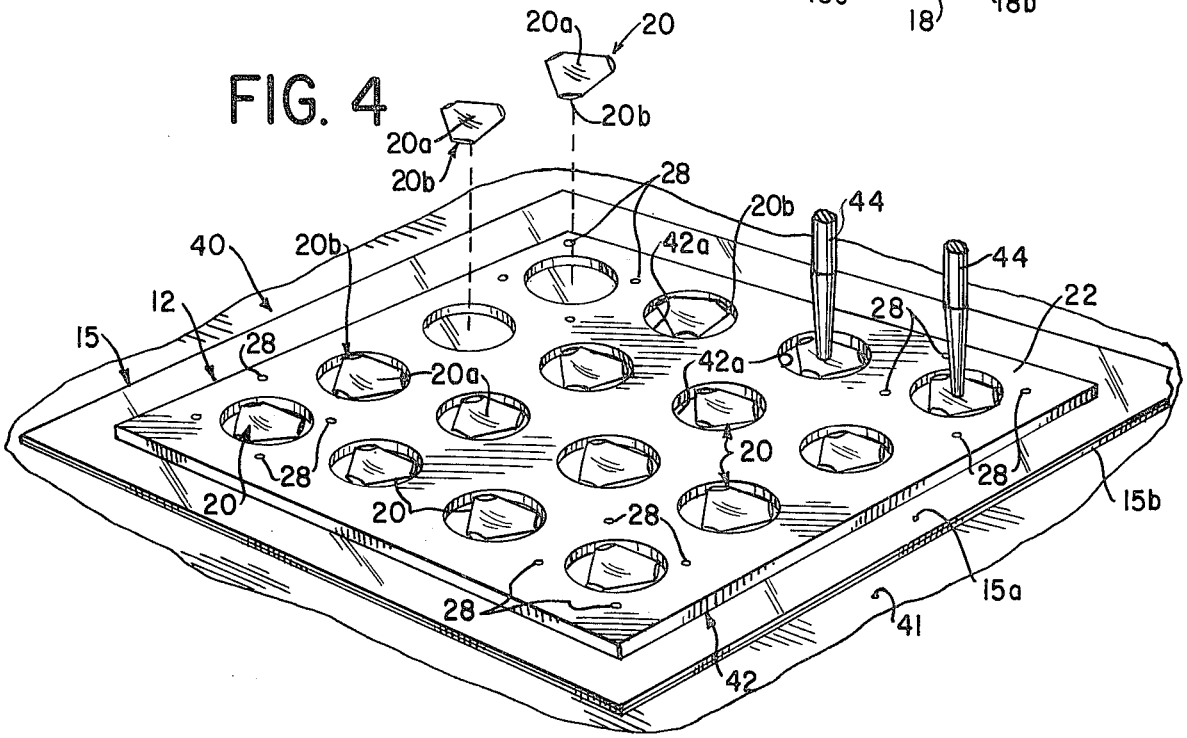
FIG. 4 is a perspective view illustrating the formation of an assembly sheet with the aid of a template, the sheet of insulative material being shown sandwiched between the template and a substantially flat surface.

The preferred method of forming assembly sheet 40 is illustrated in FIG. 4. The insulative sheet 15 is placed on a flat surface 41 with the saran surface coating 15*a* facing upwardly. The actuating members 20 are positioned on surface 15*a* with the aid of a template 42, which includes a plurality of apertures 42*a* sized to receive the actuating members 20 and positioned to correspond precisely (preferably with a point-to-point tolerance of no more than 0.002 inch) to the predefined pattern of switches on printed circuit board 12. For the purpose of positioning the actuating members 20, template 42 is placed upside down on top of insulative sheet 15 and an actuating member 20 is placed in each of apertures 42*a* so that its convex surface 20*a* is in contact with saran film 15*a*. Owing to the close tolerance of the template 42 with respect to both the placement of apertures 42*a* and the size thereof, when the actuating members 20 are placed within apertures 42*a*, they are precisely positioned on insulative sheet 15. Inasmuch as the insulative sheet 15 is held flat between the surface 41 and the template 42, creases or similar surface imperfections in sheet 15 cannot affect the accuracy of the relative positions of actuating members 20.

After an actuating member 20 has been positioned in each of apertures 42*a*, the actuating members 20 are spot-bonded to the sheet 15 by applying heat to each of the actuating members 20 by means of a tool with a heated tip 44. This causes the saran film 15*a* to become plastic and to bond the actuating member 20 to sheet 15. Clearly, the actuating members 20 could be bonded to sheet 15 either individually, by using a single heated tip 44 and treating each actuating member in turn, or by using a plurality of heated tips to treat all of the actuating members 20 simultaneously. In either case, the assembly sheet 40 is completed after each of actuating members 20 has been spot-bonded to sheet 15.

The next step in the assembly process is to invert assembly sheet 40 so that actuating members 20 depend therefrom, and to position the assembly sheet so that each of the actuating members is accurately aligned over its corresponding outer contact 16 on printed circuit board 12. It will be appreciated that, when assembly sheet 40 is inverted as explained, the actuating members will be in an arrangement corresponding to the predefined arrangement of switches 14 on printed circuit board 12, since the template 42 was turned upside down prior to positioning the actuating members 20 on sheet 15. Inasmuch as insulative sheet 15 is usually either transparent or translucent, it has been attempted to position actuating members 20 with respect to outer contacts 16 visually. However, such visual alignment has proven unsatisfactory for maintaining very close alignment of actuating members 20 with outer contacts 16.

To improve the accuracy of alignment, the method of the present invention employs at least one alignment guide 50 (see FIG. 5) which includes a planar body 50*a*, a precisely located circular apertures 50*b* and a plurality of depending legs 50*c*. The legs 50*c* are arranged to correspond precisely with the holes 28 formed about the outer switch contact in each corner of printed circuit board 12, and are sized to fit freely, but without excess clearance, inside the holes 28. As a result, the alignment guide 50 is conveniently mounted to printed circuit board 12 by inserting the legs 50*c* into holes 28 and seating the alignment guide on top of printed circuit board 12, as is shown in the left-hand portion of FIG. 5. The aperture 50*b* is dimensioned to receive an actuating member 20 with preferably about 0.005 inch clearance. Consequently, the apertures 50*b* are conveniently used as guides for scribing circles 52 on the outer conductors 16 in the four corners of printed circuit board 12. These scribed circles 52 are slightly larger than the actuating members 20 and, therefore, serve as an aid for accurately aligning assembly sheet 40 with respect to printed circuit board 12. After circles 52 are scribed on the outer conductors in the four corners of printed circuit board 12, each of the four actuating members in the corners of assembly sheet 40 is carefully aligned inside the circles scribed on its corresponding outer conductor 16, and a spot-bond 54 is formed in each of the corners of the assembly sheet 40 in order to retain the assembly sheet in alignment with respect to printed circuit board 12. This spot-bonding step is illustrated in FIG. 6, where the tip 44 of a heated tool is shown being applied to assembly sheet 40 to form one of the spot-bonds in the corner of the sheet after the spot-bonds in the other three corners have been completed.

Figure 5:
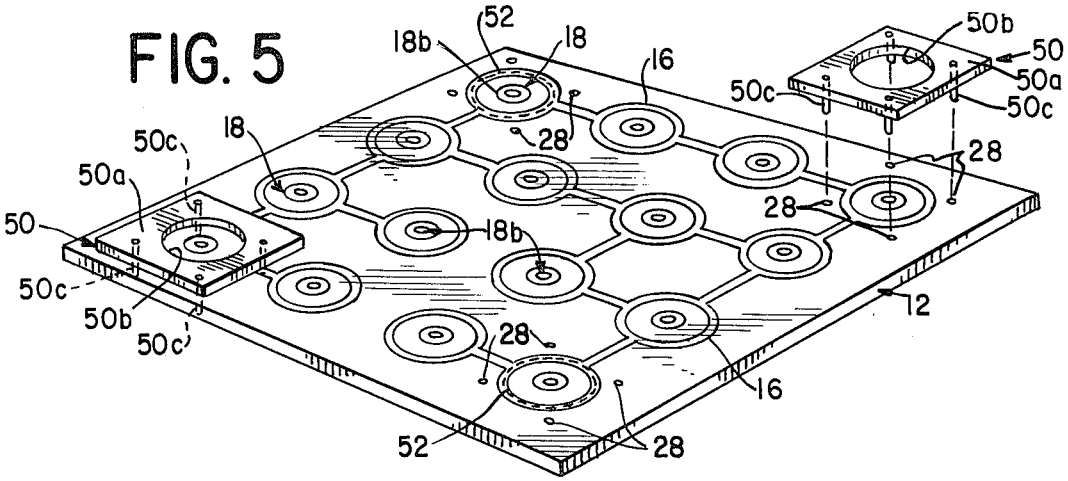
FIG. 5 is a perspective view showing the circuit board being prepared for the alignement and bonding of an assembly shet thereto, the circuit board being shown with an alignment guide mounted in one corner, a second alignment guide being inserted at a second corner, and the outer contacts in the two remaining corners having circles scribed on them after the use and removal of alignment guides.

As an alternative, it is possible to align assembly sheet 40 with respect to printed circuit board 12 by a substantially faster but less accurate method. In accordance with this less accurate method, a pair of alignment guides are mounted on printed circuit board 12 as previously described. In FIG. 5, for example, guides 50 are mounted in diagonally opposed corners of the printed circuit board. The assembly sheet is then quickly aligned with respect to the printed circuit board by placing the assembly sheet 40 over the board so that the correct actuating members are placed within the apertures 50*b* of the alignment guides 50. The assembly sheet is then smoothed and flattened and a spot-bond is placed in each of the corners where there is no alignment guide. The unbonded cornders can then be raised to remove the alignment guides and then spot-bonded to the printed circuit board 12. It will be appreciated that, to optimize the accuracy of this method of alignemnt, apertures 50*b* must provide substantially less clearance for an actuating member than specified above. Clearly, this procedure also yields the assembly of FIG. 6 comprising a printed circuit board 12 and an assembly sheet 40 tacked thereto in precise alignment.

As a final step, the assembly sheet 40 is bonded to the surface of printed circuit board 12. This step of the process is performed in a conventional heated press 60 which has a fixed base 62 and an upper platen 64 heated by an electrical element 66. Preferably, the lower surface of platen 64 is provided with a rubber layer 68 which is, preferably, approximately ⅛ of an inch thick in order to permit assembly sheet 40 to be conformed to the surface irregularities on the printed circuit board 12 occasioned by the printed circuit conductors. The rubber layer 68 is provided with a plurality of recesses 68*a* in an arrangement corresponding to the arrangement of the switches 14 on printed circuit board 12. Each of the recesses 68*a* is made deeper than the height of an actuating member 2o so that no further bonding will occur between sheet 15 and actuating members 20. To facilitate positioning of printed circuit board 12 within press 60, base 62 is provided with a recess 62*a* designed to receive the bottom of printed circuit board 12 and to retain it against movement. In operation, adhesion of assembly sheet 40 to printed circuit board 12 can be achieved with ranges of compression pressure, temperatures and compression times specified by the manufacturer of the sheet 15. However, it has been found that strongest adhesion is achieved by applying a pressure of approximately 10 pounds per square inch for about 30 seconds at a temperature of about 360° F. Upon completion of this compressing step, the completed keyswitch assembly may be removed and sheet 17 may be trimmed to the size of printed circuit board 12.

Although specific embodiments of the invention have been disclosed for illustrative purposes, it will be appreciated by those skilled in the art that many additions, modifications and substitutions are possible without departing from the scope and spirit of invention as defined in the accompaying claims.

We claim:

1. A method of manufacturing a keyswitch system having an insulative board and a plurality of switches in a predefined arrangement on one face of the board, each switch comprising a pair of spaced contacts on the board face and a resilient, electrically conductive actuating member, overlying said contacts in registry therewith and selectively operable to be deformed for providing an electrical circuit between said contacts, said method comprising the steps of:

adhering a portion of each of said actuating members, in said predefined arrangement, on a sheet of flexible insulative material to form an assembly sheet, said adhering step being performed with the aid of a planar template having a plurality of apertures therein positioned in said predefined arrangement, each of said apertures being dimensioned to receive one of said actuating members, said adhering step further comprising the steps of:

placing said template in engagement with a surface of said sheet of flexible insulative material while resting the other surface of said sheet against a substantially flat surface;

inserting an actuating member through each of said apertures of said template to contact said sheet of flexible insulative material so that said actuating members are oriented in said predefined arrangement on said sheet; and bonding each of said actuating members to said sheet of insulative material at a point of contact therewith;

positioning said assembly sheet on said circuit board with each of said actuating members facing said one board face and positioned to be opposingly aligned with its respective contacts; and securing said assembly sheet to said one face of said circuit board so that each of said actuating members is retained on said circuit board in opposed alignment with its respective contacts, thereby sealing said members to said circuit board.

2. The method of claim 1, employed in a keyswitch system wherein said sheet of flexible insulative material includes a heat sealable thermoplastic coating on the surface whereon said template is placed, said bonding step being performed by applying heat to each of said actuating members.

3. The method of claim 1 wherein said sheet of flexible insulative material includes a heat-sealable thermoplastic material on the face of said sheet facing towards said circuit board, said securing step further comprising the steps of compressing said assembly sheet against said circuit board at a pressure of approximately 10 pounds per square inch and a temperature of approximately 360° F for approximately 30 seconds.

4. The method of claim 1 wherein said positioning step is performed with the aid of a planar alignment guide having an aperture therein formed to receive one of said actuating members and being constructed and arranged to mount on said circuit board with said aperture immovably oriented over a pair of said contacts in a position corresponding to the desired orientation of the corresponding actuating member, said positioning step further including the steps of:

mounting an alignment guide to said circuit board over selected contact pairs;

scribing the outline of said alignment guide aperture on at least one of the contacts in each selected pair;

removing the alignment guide from each selected pair; and orienting said assembly sheet with respect to said circuit board so that the actuating members corresponding to the selected contact pairs are positioned within the scribed outline.

5. The method of claim 4 wherein, after said orienting step, said sheet of flexible insulative material is bonded to said one face of said circuit board at a plurality of points so that said sheet is retained in alignment with respect to said circuit board.

6. The method of claim 5 wherein said sheet of flexible insulative material includes a heat-sealable thermoplastic material on the face of said sheet facing towards said circuit board, said securing step further comprising the steps of comprising said assembly sheet against said circuit board at a pressure of approximately 10 pounds per square inch and a temperature of approximately 360° F for approximately 30 seconds.

7. The method of claim 1 wherein said positioning step is performed with the aid of a planar alignment guide having an aperture therein formed to receive one of said actuating members and being constructed and arranged to mount on said circuit board with said aperture immovably oriented over a pair of said contacts in a position corresponding to the desired orientation of the corresponding actuating member, said positioning step further including the steps of:

mounting on alignment guide to said circuit board over selected contact pairs;

orienting said assembly sheet with respect to said circuit board so that the actuating members corresponding to the selected contact pairs are positioned within the corresponding alignment guide apertures;

bonding said assembly sheet to said circuit board at a plurality of points near the perimeter thereof and remote from said alignment guides;

removing said alignment guides from said circuit board; and bonding said assembly sheet to said circuit board at additional points near the perimeter of said circuit board.

8. The method of claim 7 wherein said sheet of flexible insulative material includes a heat-sealable thermoplastic material on the face of said sheet facing towards said circuit board, said securing step further comprising the steps of compressing said assembly sheet against said circuit board at a pressure of approximately 10 pounds per square inch and a temperature of approximately 360° F for approximately 30 seconds.

9. The method of claim 1 employed in a keyswitch system wherein each pair of spaced contacts includes an inner contact and an outer contact substantially surrounding the inner contact and said actuating member has a perimeter with a predefined geometric shape and an arcuate upper surface, said actuating members being inserted into said template apertures so that at last a portion of said upper surface contacts said sheet of flexible insulating material.

10. The method of claim 9 wherein said assembly sheet is positioned so that each of said actuating members overlies the corresponding inner and outer contacts with at least a portion of its perimeter engaging the outer contact.

11. The method of claim 10 wherein said positioning step is performed with the aid of a planar alignment guide having an aperture formed to receive one of said actuating members and being constructed and arranged to mount on said circuit board with said aperture immovably oriented over an outer contact in a position corresponding to the desired orientation of the corresponding actuating member, said positioning step further including the steps of:

mounting an alignment guide to said circuit board over selected outer contacts;

scribing the outline of said alignment guide aperture on each selected outer contact;

removing the alignment guide from each selected outer contact; and orienting said assembly sheet with respect to said circuit board so that the actuating members corresponding to the selected outer contacts are positioned within the scribed outline.

12. The method of claim 11 wherein, after said orienting step, said sheet of flexible insulative material is bonded to said one face of said circuit board at a plurality of points so that said sheet is retained in alignment with repect to said circuit board.

13. The method of claim 12 wherein said sheet of flexibe insulative material includes a heat-sealable thermoplastic material on the face of said sheet facing towards said circuit board, said securing step further comprising the steps of compressing said assembly sheet against said circuit board at a pressure of approximately 10 pounds per square inch and a temperature of approximately 360° F for approximately 30 seconds.

14. The method of claim 10 wherein said positioning step is performed with the aid of a planar alignment guide having an aperture therein formed to receive one of said actuating members and being constructed and arranged to mount on said circuit board with said aperture immovably oriented over an outer contact in a position corresponding to the desired orientation of the corresponding actuating member, said positioning step further including the steps of:

mounting an alignment guide to said circuit board over selected outer contacts;

orienting said assembly sheet with respect to said circuit board so that the actuating members corresponding to the selected outer contacts are positioned within the corresponding alignment guide apertures;

bonding said assembly sheet to said circuit board at a plurality of points near the perimeter thereof and remote from said alignment guides;

removing said alignment guides from said circuit board; and bonding said assembly sheet to said circuit board at additional points near the perimeter of said circuit board.

15. The method of claim 14 wherein said sheet of flexible insulative material includes a heat-sealable thermoplastic material on the face of said sheet of flexible insulative material facing towards said circuit board, said securing step further comprising the steps of compressing said assembly sheet against said circuit board at a pressure of approximately 10 pounds per square inch and a temperature of approximately 360° F for approximately 30 seconds.

16. A method of producing an assembly sheet for use in manufacturing a keyswitch system having an insulative board and a plurality of switches in a predefined arrangement on one face of the board, each switch comprising a pair of spaced contacts on the board face and a resilient, electrically conductive actuating member, overlying said contacts in registry therewith and selectively operable to be deformed for providing an electrical circuit between said contacts, said method being performed with the aid of a planar template having a plurality of apertures therein positioned in said predefined arrangement, each of said apertures being dimensioned to receive one of said actuating elements, said method comprising the steps of:

placing said template in engagement with a surface of said sheet of flexible insulative material while resting the other surface of said sheet against a substantially flat surface;

inserting an actuating member through each of said apertures of said template to contact said sheet of flexible insulative material so that said actuating members are oriented in said predefined arrangement on said sheet; and bonding each of said actuating members to said sheet of insulative material at a point of contact therewith.

17. The method of claim 16, employed in a keyswitch system wherein said sheet of flexible insulative material includes a heat sealable thermoplastic coating on the surface whereon said template is placed, said bonding step being performed by applying heat to each of said actuating members.

18. The method of claim 16 employed in a keyswitch system wherein each pair of spaced contacts includes an inner contact and an outer contact substantially surrounding the inner contact and said actuating member has a perimeter with a predefined geometric shape and an arcuate upper surface, said actuating members being inserted into said template apertures so that at least a portion of said upper surface contacts said sheet of flexible insulating material.

19. A method for accurately aligning an assembly sheet, having a plurality of actuating members depending therefrom in a predefined arrangement, with a circuit board having a plurality of switch contact pairs thereon in said predefined arrangement, said method being performed with the aid of at least one planar alignment guide having an aperture therein formed to receive one of said actuating members and being constructed and arranged to mount on said circuit board with said aperture immovably oriented over a pair of said contacts in a position corresonding to the desired orientation of the corresponding actuating member, said method comprising the steps of:

mounting an alignment guide to said circuit board over selected contact pairs;

scribing the outline of said alignment guide aperture on at least one of the contacts in each selected pair;

removing the alignment guide from each selected pair; and orienting said assembly sheet with respect to said circuit board so that the actuating members corresponding to the selected contact pairs are positioned within the scribed outline.

20. The method of claim 19 wherein, after said orienting step, said sheet of flexible insulative material is bonded to said one face of said circuit board at a plurality of points so that said sheet is retained in alignment with respect to said circuit board.

21. A method for accurately aligning an assembly sheet, having a plurality of actuating members depending therefrom in a predefined arrangement, with a circuit board having a plurality of switch contact pairs thereon in said predetermined arrangement, said method being performed with the aid of at least one planar alignment guide having an aperture therein formed to receive one of said actuating members and being constructed and arranged to mount on said circuit board with said aperture immovably oriented over a pair of said contacts in a position corresponding to the desired orientation of the corresponding actuating member, said method comprising the steps of:

mounting an alignment guide to said circuit board over selected contact pairs;

orienting said assembly sheet with respect to said circuit board so that the actuating members corresponding to the selected contact pairs are positioned within the corresponding alignment guide apertures;

bonding said assembly sheet to said circuit board at a plurality of points near the perimeter thereof and remote from said alignment guides;

removing said alignment guides from said circuit board; and bonding said assembly sheet to said circuit board at additional points near the perimeter of said circuit board.

* * * * *